United States Patent [19]

Kozima

[11] 4,055,067

[45] Oct. 25, 1977

[54] METHOD AND A PUNCH/DIE ASSEMBLY FOR THE PRODUCTION OF HEAT EXCHANGER FINS

[75] Inventor: Toyoo Kozima, Tokyo, Japan

[73] Assignee: Hidaka Engineering Co., Ltd., Tokyo, Japan

[21] Appl. No.: 604,306

[22] Filed: Aug. 13, 1975

[30] Foreign Application Priority Data

Sept. 11, 1974 Japan ..... 49-103808

[51] Int. Cl.[2] ..... B21D 31/02

[52] U.S. Cl. ..... 72/328; 72/335; 72/356

[58] Field of Search ..... 72/327, 328, 333, 334, 72/335, 354, 356; 83/549

[56] References Cited

U.S. PATENT DOCUMENTS

| | | | |
|---|---|---|---|
| 2,341,462 | 2/1944 | Matson | 72/336 |
| 3,491,576 | 1/1970 | Oguri et al. | 72/354 X |
| 3,507,140 | 4/1970 | Tassaro | 72/327 |
| 3,600,998 | 8/1971 | Palmer | 83/549 |

*Primary Examiner*—Leon Gilden

[57] ABSTRACT

A method of producing heat exchanger fins, comprising the steps of perforating an aperture of a small diameter in a predetermined portion of a sheet material, while simultaneously forming a perpendicularly projecting cylinder of a diameter smaller than that of the flanged aperture to be ultimately formed, and machining said perpendicularly projecting cylinder into a flange of a predetermined dimension by simultaneous burring and ironing operations using a punch of a predetermined size.

4 Claims, 9 Drawing Figures

FIG. 1 PRIOR ART
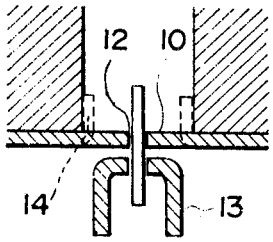
FIG. 2 PRIOR ART
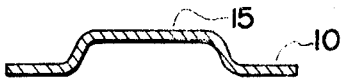
FIG. 3 PRIOR ART
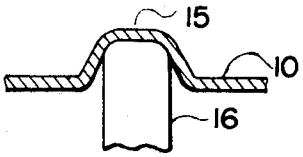
FIG. 4
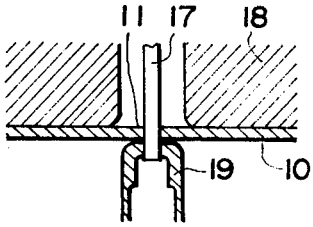
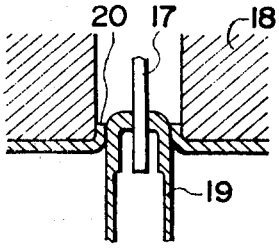
FIG. 5
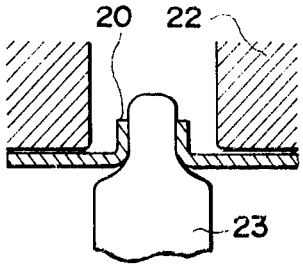
FIG. 6

METHOD AND A PUNCH/DIE ASSEMBLY FOR THE PRODUCTION OF HEAT EXCHANGER FINS

BACKGROUND OF THE INVENTION

This invention relates to a method and a punch/die assembly for use in the production of heat exchanger fins as in, for example, air conditioners for rooms and motor vehicles, and, in particular, to a method which does not require any preliminary punching prior to the regular punching indispensable to the conventional manufacturing process of said fins, which contributes to remarkable improvement of productive efficiency and quality of products.

In general, the cooling fins are constituted by a number of superposed square sheets each having a multiple number of flanged apertures in registration with similar flanged apertures in the overlying and underlying sheets, and a number of copper tubes passed through the respective flanged apertures. The flanges are usually turned outwardly to form beads around the marginal edges of the apertures for the purposes of maintaining a predetermined distance between the adjacent apertures and at the same time for reinforcing purposes. Therefore, the flanges are required to have at least projecting and curling height by more than 1.8 mm.

Referring to FIG. 1 of the accompanying drawings, in forming a flanged aperture 14 in an aluminum sheet 10, it has been the conventional practice to perforate in the first step an aperture 12 which has a diameter far smaller than that of a flanged aperture 14 to be ultimately formed, pressing the marginal edge portions upwardly by means of a punch 13 thereby to form the flanged aperture 14 of the predetermined dimension. However, where the aperture 12 is formed in a small diameter in an attempt to increase the height of the ultimate flange, cracking often occurs to the marginal edge portions of the aperture when pressed by the punch. Therefore, without a preliminary treatment or machining, it has been difficult to form a flange which has a height greater than 1.8 mm.

The pre-machining usually includes pressing of the coiled aluminum material 10 by a punch to form a bonnet-like recess 15 of a diameter far larger than that of the intended flanged aperture, as shown in FIG. 2, and further pressing of the recessed portion 15 by another punch to reduce its diameter while increasing its height as shown particularly in FIG. 3. These operations are repeated to obtain a number of flanged apertures 14 of the predetermined diameter and height as shown in FIG. 1. This method is generally referred to as "drawing" and is capable of forming a flange of a relatively great height by the gradual or progressive stretching of the coiled aluminum material 10. However, the just-mentioned method has inherent drawbacks in that the circumferencial wall of the flanged aperture 14 bears concentric hammered marks as a result of the repeated punching operation and wrinkles appear at the both ends of the coiled aluminum material 10 to cause warping or distortion to the fins as a whole.

SUMMARY OF THE INVENTION

It is an object of the present invention to provide a method and a punch/die assembly for use in the production of heat exchanging fins with high efficiency.

It is another object of the present invention to provide a method and a punch/die assembly capable of producing heat exchanging fins of excellent quality.

It is a further object of the invention to provide a method and a punch/die assembly for producing heat exchanger fins which generate only low noises under compressed operating conditions.

In one preferred form of the invention, the method of producing heat exchanger fins comprises the first step of perforating a small aperture at a predetermined position of coiled aluminum material, without the aforementioned pretreatment, while simultaneously forming a perpendicularly projecting cylinder of a diameter smaller than that of the flanged aperture to be ultimately formed, and the second step of burring and ironing the perpendicularly projecting cylinder into a predetermined dimension with use of a punch of a predetermined size.

BRIEF DESCRIPTION OF THE DRAWINGS

FIG. 1 is a diagrammatic sectional view illutrating a conventional method of forming a flanged aperture;

FIGS. 2 and 3 are diagrammatic sectional views illustrating operational procedures in the conventional pretreatment;

FIGS. 4 to 7 are diagrammatic sectional views illustrating the method of forming a flanged aperture according to the invention;

DETAILED DESCRIPTION OF THE INVENTION

Figure 7:
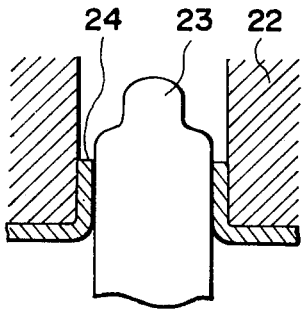
Figure 8:
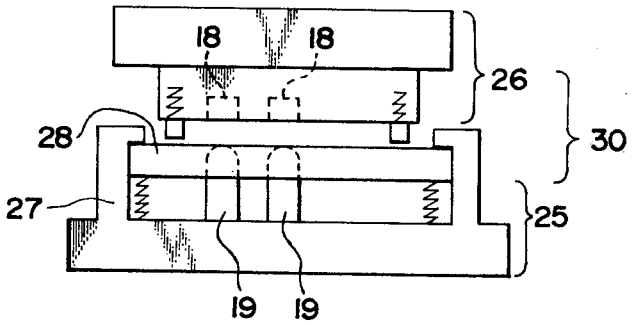
FIG. 8 is a diagrammatic front elevation of the punch and die assembly.

The method of producing heat exchanger fins according to the invention will now be described more particularly by way of a preferred embodiment shown in FIGS. 4 to 7. Referring to these figures, a small aperture 11 is perforated in the coiled aluminum material in the form of a sheet 10 by means of a punch 17. As the punch 17 is urged into a die 18, a relatively short cylinder 20 is formed around the small aperture 11 in the coiled aluminum material which is held against the lower surface of the die 18, as shown in FIGS. 4 and 5. The coiled aluminum material 10 is then placed between another die 22 and a punch which is designed to have a size conforming with the die 22 is pressed into the die 22 to form the perpendicular cylinder 22 into a flange of a predetermined height as illustrated in FIGS. 6 and 7.

According to the method of the invention, a small perpendicularly projecting cylinder 20 is formed in the first step at a desired position on the coiled aluminum material 10, and, in the second step, the perpendicularly projecting cylinder 20 is further pressed out by a punch 23. In this instance, the upper circumferencial portions of the perpendicularly projecting cylinder 20 is deformed by the punch 23 but with only a reduced tensioning stress, so that a perpendicular flange 24, which has a height of 2.8 mm in the particular embodiment shown, may be formed without difficulty and at the same time without causing cracking or other troubles.

Figure 9:
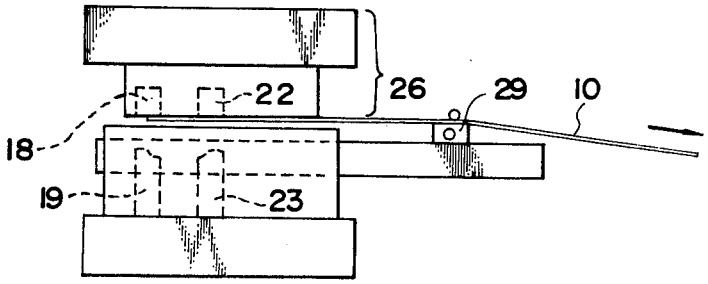
FIG. 9 is a diagrammatic side elevation of the same punch and die assembly.

In the actual operation, the afore-mentioned first and second steps are carried out with use of a set of dies 18 and 22 and a set of punches 19 and 23 which ar supported on a punch/die assembly 30. The punch and die assembly 30 comprises an upper tool holder 26 and a lower tool holder 25 having integrally therewith a stripper plate 28 which is constantly urged upwardly by springs within a guide frame 27. The upper and lower tool holders 26 and 25 of the punch and die assembly 30 are mounted on a suitable press machine such that the upper tool holder 26 is pressed downwardly against spring action to effect the afore-mentioned first and second punching operations. More particulary, the upper tool holder 26 mounts thereon the die 18 for the first punching operation and the die 22 for the second punching operation, the dies 18 and 22 being aligned in the direction of advancement of the workpiece 10 (from left to right as seen in FIG. 9) in one or a plural number of sets. The coiled aluminum material or workpiece 10 undergoes the first and second punching operations as it is moved intermittently or incrementally by means of a hitch-feeding mechanism 29 which is provided separately from the punch and die assembly 30. The just-mentioned dies 18 and 22 and the punches 19 and 23 are preferably provided in a plural number and arrayed respectively in the lateral direction (in the direction perpendicular to the workpiece feeding direction) to form simultaneously a plural number of laterally aligned flanged apertures 24 in relation with the intermittent movement of the workpiece 10. The hitch-feeding mechanism 29 in the coiled aluminum material is driven in timed relation with the reciprocating movement of the upper tool holder 29.

It will be understood from the foregoing description that the present invention can completely dispense with the aforementioned pretreatments. This means that there is no need for mounting additional punches and dies on the upper and lower tool holders 26 and 25 of the assembly for the pre-machining. The stripper plate 28 which is moved up and down against the spring action is free from impacts and contributes to reduce the operation noises which would otherwise result from its reciprocating movements.

In the above-described embodiment, the punch 19 is mounted on the fixed lower tool holder 25 and the die 18 on the movable upper tool holder 26. However, needless to say, it is also possible to mount the die 18 on the lower holder 25 and the punch 19 on the upper holder 26.

What is claimed is:

1. A punch and die assembly for use in the formation of flanged apertures in heat-exchanger fins, said assembly comprising a lower tool holder supporting on the upper surface thereof a plurality of sets of first and second punches with said punches in said sets being at a predetermined distance from each other, and an upper tool holder mounting on the lower surface thereof a plurality of sets of first and second dies in conformity with said first and second punches, one of said tool holders being movable towards and away from said other tool holder, said first dies each having a relatively small diameter and said first punches each having first and second surface means that, respectively, punch and bend a plurality of small diameter, flanged apertures at predetermined positions on a single workpiece, said second punches each having a first portion that substantially conforms in size to said second surface means of said first punches and a second portion that is larger than said first portion, said second dies each having a single size opening that cooperates with said second portion of said second punches whereby said second dies and said second punches are adapted to enlarge the diameter of said small apertures into perpendicularly projecting cylinders of a predetermined length dimension by simultaneous burring and ironing operations.

2. A punch and die assembly as set forth in claim 1, further comprising a hitch-feeding mechanism for drawing a workpiece over said punches incrementally through said predetermined distances.

3. A punch and die assembly as set forth in claim 1, wherein said lower tool holder is provided with a stripper plate which is resiliently supported within a guide frame by means of a spring.

4. A method for producing heat-exchanger fins, comprising the steps of perforating predetermined portions of a single sheet of metal to define a plurality of apertures each having a diameter that is smaller than the diameter of the flanged apertures that are to be ultimately formed, forming from each of the small diameter apertures a perpendicularly projecting cylinder having a diameter smaller than the diameter of the flanged apertures to be ultimately formed by using a plurality of first punches each having a diameter smaller than the diameter of the ultimately formed flanged apertures and a plurality of first dies each having a perforating punch, and machining each said perpendicularly projecting cylinder to enlarge the diameter thereof to thereby form the desired flanged apertures by simultaneous burring and ironing operations using a second plurality of punches and dies that have a diameter that is larger than the first plurality of punches and dies.

* * * * *